US005433186A

United States Patent [19]

Corwin

[11] Patent Number: 5,433,186

[45] Date of Patent: Jul. 18, 1995

[54] BOW PRESS AND METHOD FOR COMPRESSING BOWS

[76] Inventor: Clay Corwin, P.O. Box 261, Blythe, Calif. 92226

[21] Appl. No.: 206,676

[22] Filed: Mar. 7, 1994

[51] Int. Cl.[6] ..... F41B 5/14

[52] U.S. Cl. ..... 124/86; 124/1

[58] Field of Search ..... 124/1, 23.1, 25, 86, 124/88, 90

[56] References Cited

U.S. PATENT DOCUMENTS

| | | | |
|---|---|---|---|
| 3,055,655 | 9/1962 | Chelp | 124/86 X |
| 4,993,397 | 2/1991 | Cryar et al. | 124/23.1 |
| 5,022,377 | 6/1991 | Stevens | 124/23.1 |
| 5,115,795 | 5/1992 | Farris | 124/86 |
| 5,121,736 | 6/1992 | Hawk | 124/86 |
| 5,220,906 | 6/1993 | Choma | 124/25 |
| 5,222,473 | 6/1993 | Lint | 124/86 |

*Primary Examiner*—Randolph A. Reese
*Assistant Examiner*—John A. Ricci
*Attorney, Agent, or Firm*—Timothy T. Tyson; Freilich, Hornbaker & Rosen

[57] ABSTRACT

A bow press (20) and a method for compressing the limbs (156) and (158) of archery bows (150) in order to remove the tension from the bow string (160) and thereby permit adjustment, repair, and replacement of strings (160), tension cables, wheels and the like is disclosed. The bow press (20) employs a fixed arm (80) and a movable arm (114) to exert force on the bow (150) so that the limbs (156) and (158) move inwardly toward one another and thereby relax the tension on the bow string (160). The bow press (20) can also be utilized to compress an unstrung and totally relaxed bow (150).

19 Claims, 6 Drawing Sheets

PRIOR ART

PRIOR ART

BOW PRESS AND METHOD FOR COMPRESSING BOWS

TECHNICAL FIELD

The present invention pertains to bow presses and a method for compressing the limbs of archery bows in order to remove the tension from the bow string and thereby permit adjustment, repair, and replacement of strings, tension cables, wheels and the like.

BACKGROUND ART

Devices for compressing the limbs of archery bows have been known in the art for many years. U.S. Pat. No. 3,000,628 discloses a bow stringer for stringing either a recurved or straight bow. U.S. Pat. No. 3,055,655 shows a device for accurately stringing bows wherein it is impossible to misalign the string with the lateral axis of the bow. U.S. Pat. No. 4,993,397 describes an apparatus for calibrating bows and enabling proper adjustments to be made. U.S. Pat. No. 5,022,377 discloses a portable bow press for facilitating repair and adjustment of an archer's compound-type bow. U.S. Pat. No. 5,121,736 shows an archery bow sighting and tuning apparatus.

In addition to the above cited U.S. Patents, there exist several commercially available archery bow presses. Two such presses are particularly worthy of mention, and are briefly described in the following paragraphs.

The "Bow Compressor", manufactured and sold by Rampro Sporting Goods Division, 2500 Greenwell Court, Wilmington, N.C. is depicted in FIG. 1 and FIG. 2. This device, generally designated as 500, comprises a base 501, to which are attached two compression arms 502 and 503. The compression arms 502 and 503 rotate around pivot points 504 and 505. Two rollers 506 and 507 are attached to end of the two compression arms 502 and 503. A bow generally designated as 150, having tensioned bow string 160, is loaded in the compressor such that the two bow limbs 156 and 158 rest upon the two rollers 506 and 507. The face of the bow 154 is vertically retained in position by straps 508 and 509. Wheel 510 is manually rotated as indicated by arrow 511. This causes screw 512 to engage elevator arms 513 and 514 thereby causing compression arms 502 and 503 to move in the respective directions of arrows 515 and 516. This causes inward compression of bow limbs 156 and 158, and resultantly, bow string 160 is relaxed so that the desired adjustment or repair actions may be effected.

The "Kwik-Jak" Speed Bow Press, manufactured and sold by Lancaster Archery Supply, 2195A Old Philadelphia Pike, Lancaster, Pa. 17602 is depicted in FIG. 3 and FIG. 4. This device, generally designated as 600, comprises a base 601, to which is attached a fixed bar 602. Compression arms 603 and 604 rotate around pivot points 605 and 606. Two rollers 607 and 608 are attached near the ends of the fixed bar 602, and two additional rollers 609 and 610 are attached near the ends of compression arms 603 and 604. Cable 612 is attached to compression arms 603 and 604 via cable fulcrum 613 which is attached to jack mechanism 614 having jack handle 615. A bow generally designated as 150, having tensioned bow string 160, is loaded in the bow press such that the two bow limbs 156 and 158 rest upon the two rollers 609 and 610. Jack handle 615 is operated causing cable fulcrum 613 to move vertically in the direction of arrow 616. This vertical motion causes the cable 612 to pull the compression arms 603 and 604 upward in the direction of the arrows 617 and 618. The upward motion of the compression arms causes the face of the bow 154 to engage the rollers 607 and 608, and continued upward motion causes inward compression of bow limbs 156 and 158, and resultantly, bow string 160 is relaxed so that the desired adjustment or repair actions may be effected.

Each of the aforestated prior art devices have one or more specific limitations and disadvantages. These limitations and disadvantages include, (1) marginal portability, (2) lengthy set up time, (3) discontinuous incremental operation, (4) lack of rotation stops, (5) inability to accommodate an unstrung totally relaxed bow, and (6) inability to accommodate all bow types and configurations. The present invention overcomes all of these limitations and disadvantages by employing a unique combination of prior art features with new and heretofore unsuggested technical methods.

DISCLOSURE OF INVENTION

The present invention is directed to an improved bow press and method for compressing the limbs of archery bows in order to remove the tension from the bow string and thereby permit adjustment, repair, and replacement of strings, tension cables, wheels and the like. The present invention may also be utilized to compress an unstrung and totally relaxed bow for the purpose of stringing. The present invention combines several advantageous features found in existent bow presses, and most importantly, utilizes two new design principles, rotation stops and a downwardly angled movable arm, to achieve enhanced press performance.

In accordance with a preferred embodiment of the invention, the bow press is comprised of a fixed sleeve connected to a base, a movable sleeve, and a support shaft slidably joining the two sleeves. An expander means for expanding and contracting the bow press is connected to the moveable sleeve and the support shaft. Actuation of the expander means causes the movable sleeve to slide along the support shaft and therefore causes the movable sleeve to move with respect to the fixed sleeve.

In accordance with one embodiment of the invention, the expander means consists of a jackscrew.

In accordance with a preferred embodiment of the invention, a fixed arm is perpendicularly connected to the fixed sleeve, and a movable arm is perpendicularly connected to the movable sleeve. Bow engaging means for exerting force upon the bow are adjustably mounted on the fixed and movable arms. The limbs of a tensioned bow are placed upon the bow engaging means of the movable arm. As the expander means is .actuated, the fixed arm and movable arm separate or open until the bow engaging means of the fixed arm contact the face of the bow. Continued actuation of the expander means causes the limbs of the bow to compress inwardly and therefore relax the tension in the bow string.

In accordance with an important aspect of the invention, elongated rotation stops are attached to the ends of the fixed arm. These stops prevent the movable arm from rotating as the expander means is actuated.

In accordance with another important aspect of the invention, the outer portions of the movable arm are angled downward. This unique feature permits a totally relaxed or unstrung bow to be inserted into the present invention and then compressed for stringing and placement in shooting order. Similarly, narrow straight bows can be accommodated by the present invention, whereas these bows could not be installed on the bow press and compressed if the movable arms were not angled downward.

In accordance with other important aspects of the invention, the bow press is extremely easy to use, requires minimal set up time, is simple and inexpensive in construction, is continuous and smooth in operation, is highly portable, and can be used on compound, recurved or straight bows.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
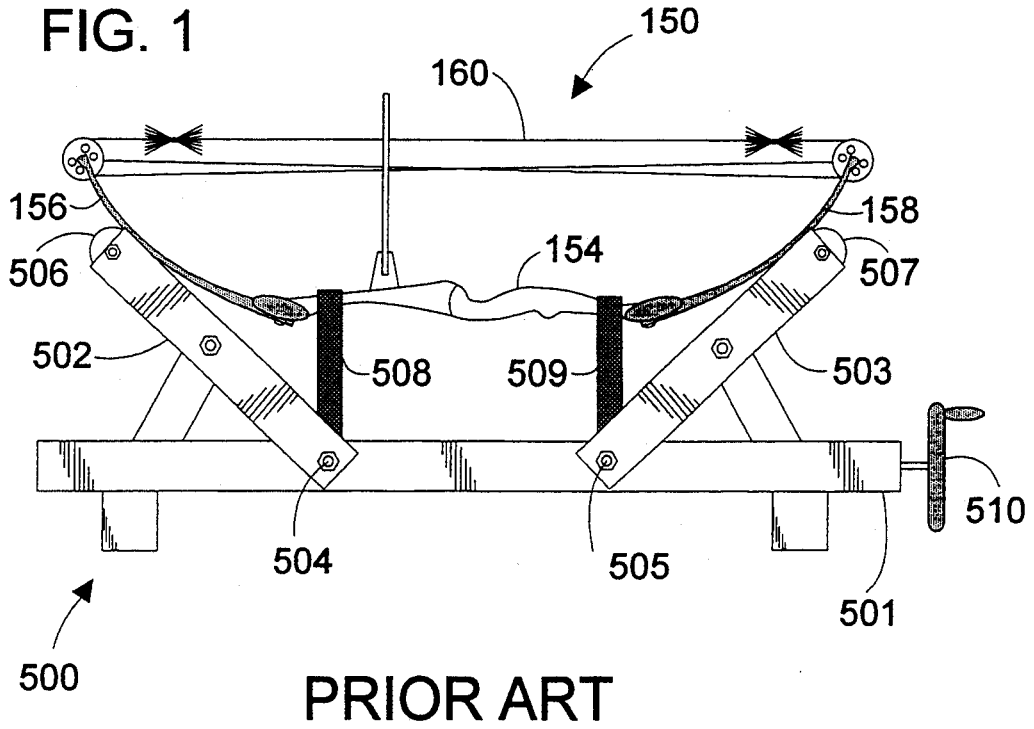
FIG. 1 is a front view of a first prior art bow press showing an installed bow in the tensioned position.
Figure 2:
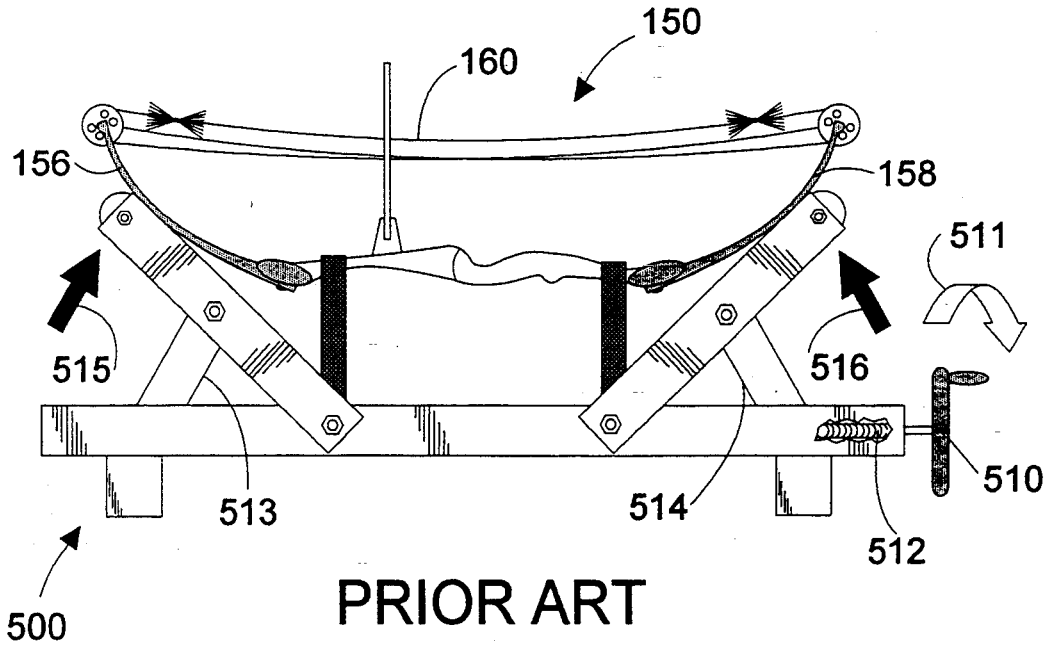
PRIOR ART FIG. 2
FIG. 2 is a front view of the first prior art bow press showing the bow in the compressed position.
Figure 3:
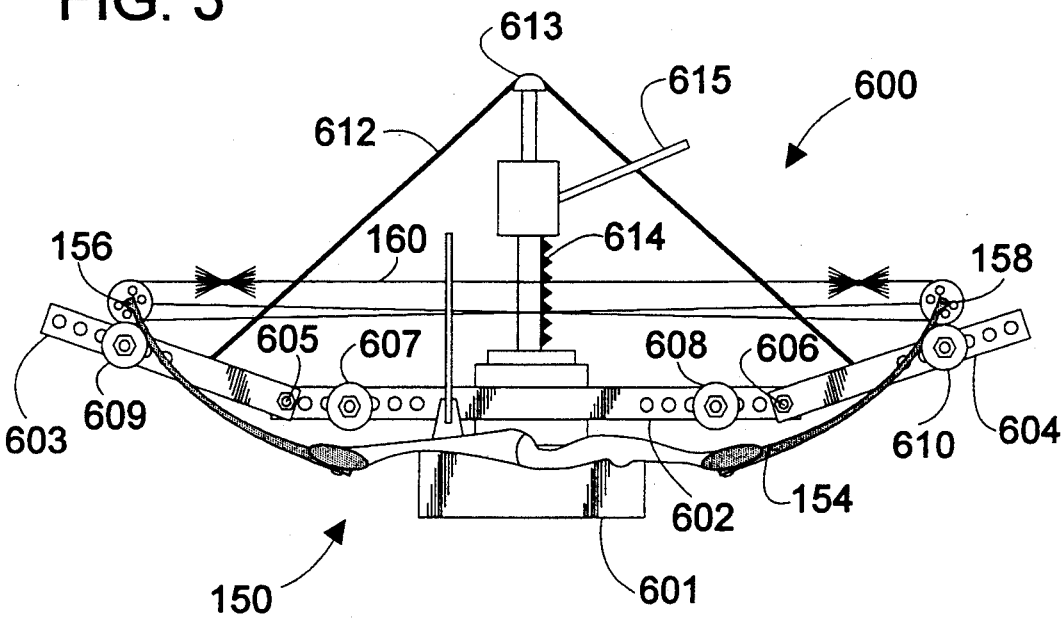
FIG. 3 is a front view of a second prior art bow press showing an installed bow in the tensioned position.
Figure 4:
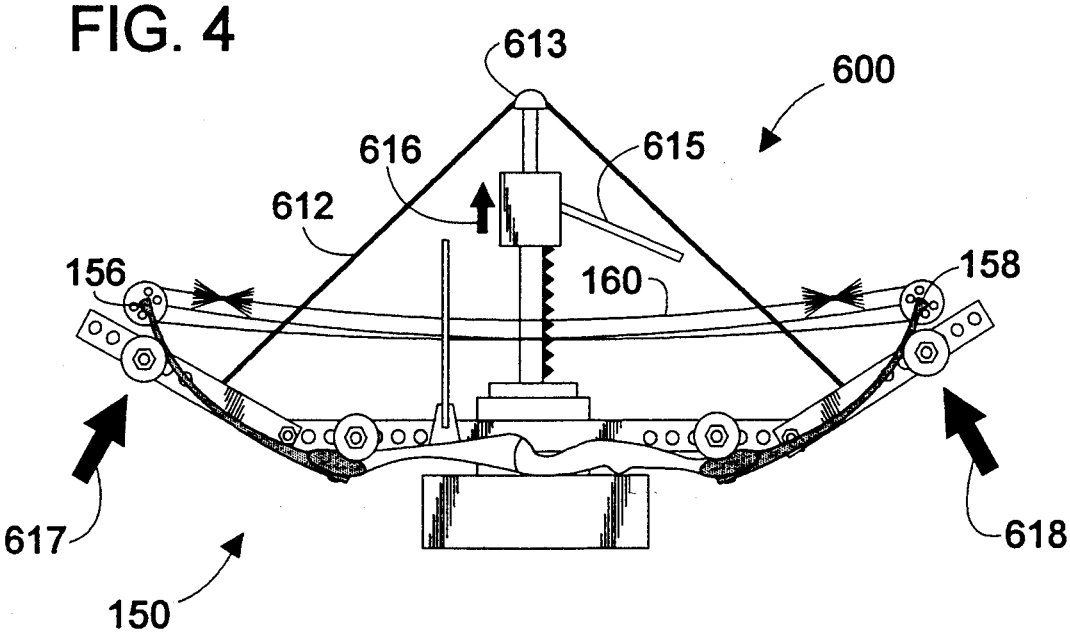
PRIOR ART FIG. 4
FIG. 4 is a front view of the second prior art bow press showing the bow in the compressed position.
Figure 5:
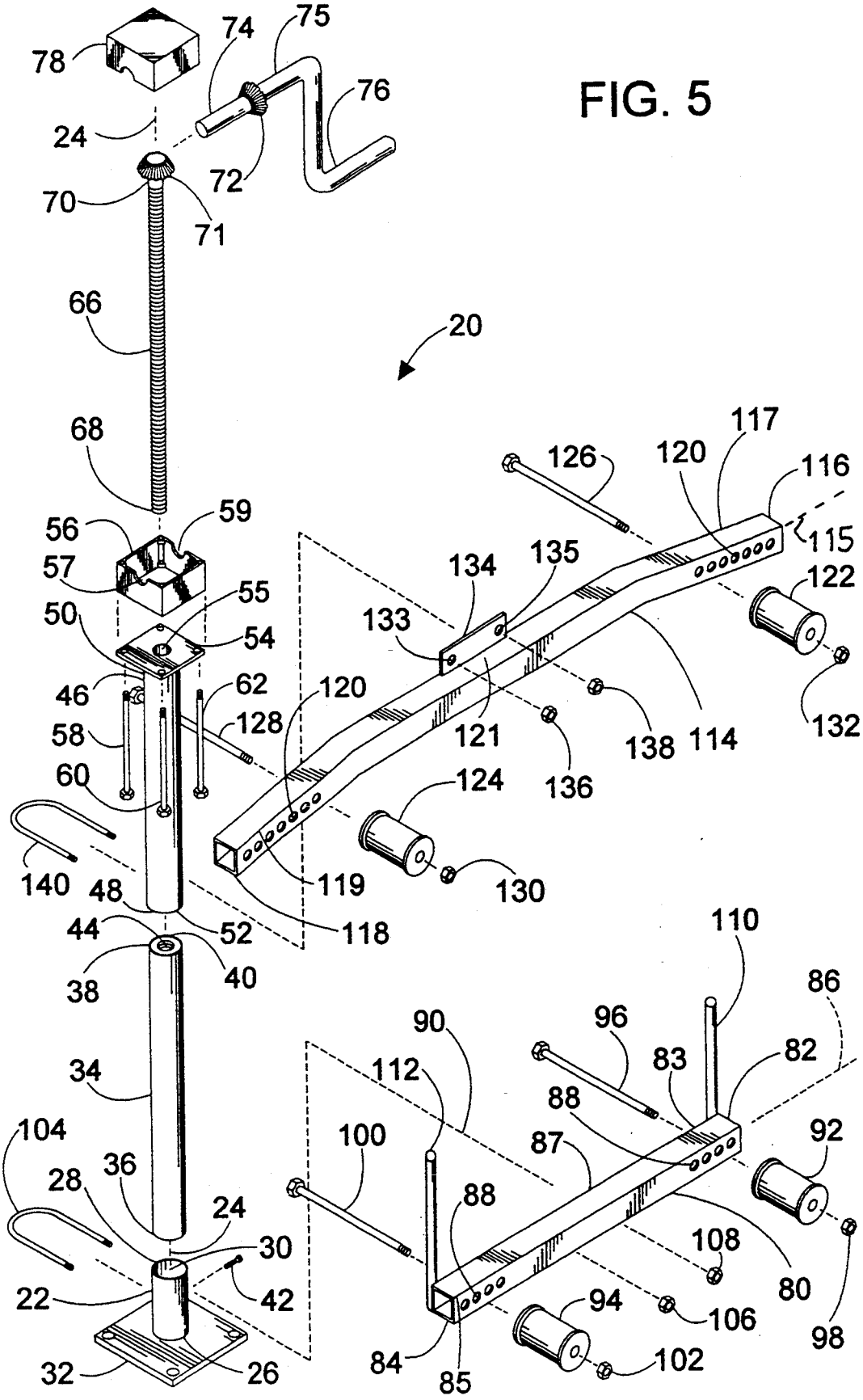
FIG. 5 is a perspective exploded view of the bow press in accordance with the present invention.

Referring initially to FIG. 5, there is illustrated an exploded perspective view of a bow press in accordance with the present invention, generally designated as 20. A fixed sleeve 22 orients the bow press around a first axis 24. The fixed sleeve 22 has a first end 26, a second end 28, and a predetermined internal cross sectional area 30. A substantially planar base 32 defines a plane perpendicular to the first axis 24,, The planar base 32 is perpendicularly connected to the first end 26 of the fixed sleeve 22.

A support shaft 34 is longitudinally oriented around the first axis 24. The support shaft 34 has a first end 36, a second end 38, and a predetermined external cross sectional area 40. The predetermined external cross sectional area 40 is sized to longitudinally fit into the internal cross sectional area 30 of the fixed sleeve 22. The support shaft 34 is longitudinally inserted into the second end of the fixed sleeve 22 and firmly held in position by a first retaining means 42 for holding the support shaft 34 in position within the fixed sleeve. In the shown embodiment *the first retaining means 42 consists of a set screw engaging a threaded hole (hidden) in the fixed sleeve 22, the set screw pressing against the support shaft 34. However, other temporary or permanent retaining means such as pins, clips, clamps, glue, soldering, welding or the like could also be used.

A movable sleeve 46 is longitudinally oriented around the first axis 24. The movable sleeve 46 has a first end 48, a second end 50, and a predetermined internal cross sectional area 52 equal to the predetermined cross sectional area 40 of the fixed sleeve. The support shaft 34 is longitudinally inserted into the first end 48 of the movable sleeve 46. A mounting flange 54 is integrally and perpendicularly connected to the second end 50 of the movable sleeve 46. The mounting flange 54 has an aperture 55 of predetermined diameter axially oriented around the first axis 24.

An expander means for expanding and contracting the bow press is movably connected to the second end 38 of the support shaft 34, and also connected to the mounting flange 54. In the shown embodiment the expander means consists of a jackscrew and associated components. A threaded aperture 44 is integrally connected to the second end 38 of the support shaft 34. The threaded aperture 44 is axially oriented around the first axis 24. A threaded rod 66 is longitudinally oriented along the first axis 24. The threaded rod 66 has a first end 68 and a second end 70. The threaded rod 66 has threads sized to fit the threads of the threaded aperture 44, and the threaded rod 66 has a diameter slightly less than the predetermined diameter of the aperture 55 in the mounting flange 54. The first end 68 of the threaded rod 66 is longitudinally inserted through the aperture 55 until the threads of the threaded rod 66 engage the threaded aperture 44. A first bevel gear 71 is integrally connected to the second end 70 of the threaded rod 66. The first bevel gear 71 is centrally oriented along the first axis 24. A rotation handle 76 has an axially connected second bevel gear 72. The second bevel gear 72 perpendicularly meshes with the first bevel gear 71. The rotation handle 76 has a nipple portion 74 and a shank portion 75. Atwood Mobile Products, 4750 Hiawatha Drive, Rockford, Ill. 61103-1298 manufactures a jackscrew well adapted for use in the present invention. While the shown expander means embodiment consists of a jackscrew, other forms of mechanical or hydraulic jacks could also be employed.

A housing consisting of top piece 78 and bottom piece 56 surrounds the first bevel gear 71 and the second bevel gear 72 and is connected to the mounting flange 54. The housing has two support holes 57 and 59 which receive and firmly hold the nipple portion 74 and shank portion 75 of the rotation handle 76 in place so that the first bevel gear 71 and second bevel gear 72 are continuously meshed. The top piece 78 and bottom piece 56 of the housing are connected to the mounting flange 54 by bolts 58, 60, 62, and a fourth bolt hidden behind the sleeve 46 which engage threaded holes in the top piece 78.

When the rotation handle 76 is turned, the second bevel gear 72 engages the first bevel gear 71 causing the threaded rod 66 to longitudinally move with respect to the threaded aperture 44. This causes the movable sleeve 46 to move down or up the support shaft 34 depending on whether the rotation handle 76 is turned in a clockwise of counterclockwise direction.

A fixed arm 80 of predetermined length is oriented along a second axis 86 which is perpendicular to the first axis 24. The fixed arm 80 has a first end 82 and a second end 84. The fixed arm is divided into three longitudinal portions. A first longitudinal portion 83 is adjacent to the first end 82, a second longitudinal portion 85 is adjacent to the second end 84, and a central longitudinal portion 87 is located between the first longitudinal portion 83 and the second longitudinal portion 85. The first longitudinal portion 83 and the second longitudinal portion 85 have a plurality of predetermined longitudinally spaced holes 88 axially oriented parallel to a fourth axis 90 which is perpendicular to both the first axis 24 and the second axis 86. The plurality of holes 88 permits adjustment of the invention to accommodate various lengths, widths, shapes and other physical bow configurations. In the shown embodiment, the fixed arm 80 is constructed from rectangular metal tubing, however any ridged elongated member could also suffice.

A first bow engaging means 92 for exerting force from the fixed arm to the bow is connected to one of the plurality of holes 88 in the first longitudinal portion 83, and a second bow engaging means 94 for exerting force from the fixed arm to the bow is connected to one of the plurality of holes 88 in the second longitudinal portion 85. In the shown embodiment the first 92 and second 94 bow engaging means consist of spool rollers having axes of rotation parallel to the fourth axis 90. These rollers may be made of wood, plastic, or another soft material so they will not mar the installed bow during the compression process. Other bow engaging means such as fixed rods may also be utilized. The spool rollers are connected to the fixed arm 80 by bolts 96 and 100 and nuts 98 and 102. The spool rollers are shown connected to the second most outwardly holes 88. The spool rollers may be connected to other holes 88 to accommodate different bow configurations.

A second retaining means for connecting the fixed arm 80 to the fixed sleeve 22 is connected to the central longitudinal portion 87 of the fixed arm 80 and to the fixed sleeve 22, and firmly holds the fixed arm 80 in position along the fixed sleeve 22. In the shown embodiment the second retaining means consists of a first flange 103 (FIG. 8) similar to a second flange 134 described below having two holes. The flange is integrally connected to the central longitudinal portion 87 of the fixed arm 80. A first U bolt 104 surrounds the fixed sleeve 22 and engages the two holes in the first flange and removably holds the fixed sleeve 22 and the fixed arm 80 together. Nuts 106 and 108 lock the U bolt 104 in position. U bolt 104 is a convenient and economical method of attaching the fixed arm 80 to the fixed sleeve 22, and additionally permits vertical adjustment of the position of the fixed arm 80 along the fixed sleeve 22. However, other temporary or permanent retaining means such as pins, screws, bolts, clamps, welding or the like could also be used.

A movable arm 114 of a predetermined length longer than the predetermined length of the fixed arm 80 is oriented along a third axis 115 parallel to the second axis 86. The movable arm 114 has a first end 116 and a second end 118. The movable arm is divided into three longitudinal portions. A first longitudinal portion 117 is adjacent to the first .end 116, a second longitudinal portion 119 is adjacent to the second end 118, and a central longitudinal portion 121 is located between the first longitudinal portion 117 and the second longitudinal portion 119. The first longitudinal portion 117 and the second longitudinal portion 119 have a plurality of predetermined longitudinally spaced holes 120 axially oriented parallel to the fourth axis 90. The plurality of holes 120 permit adjustment of the invention to accommodate various lengths, widths, shapes and other physical bow configurations. In the shown embodiment, the movable arm 114 is constructed from rectangular metal tubing, however any ridged elongated member could also suffice.

A third bow engaging means 122 for exerting force from the movable arm to the bow is connected to one of the plurality of holes 120 in the first longitudinal portion 117, and a fourth bow engaging means 124 for exerting force from the movable arm to the bow is connected to one of the plurality of holes 120 in the second longitudinal portion 119. In the shown embodiment the third 122 and fourth 124 bow engaging means consist of spool rollers having axes of rotation parallel to the fourth axis 90. These rollers may be made of wood, plastic, or another soft material so they will not mar the installed bow during the compression process. Other bow engaging means such as fixed rods may also be utilized. The spool rollers are connected to the movable arm 114 by bolts 126 and 128 and nuts 130 and 132.

A third retaining means for connecting the movable arm 114 to the movable sleeve 46 is connected to the central longitudinal portion 121 of the movable arm 114 and to the movable sleeve 46, and firmly holds the movable arm 114 in position along the movable sleeve 46. In the shown embodiment the third retaining means consists of a second arm flange 134 having two holes 133 and 135. The second arm flange 134 is integrally connected to the central longitudinal portion 121 of the movable arm 114. A second U bolt 140 surrounds the movable sleeve 46 and engages the two holes 133 and 135 in the second flange 134 and removably holds the movable sleeve 46 and the movable arm 114 together. Nuts 136 and 138 lock the U bolt 140 in position. U bolt 140 is a convenient and economical method of attaching the movable arm 114 to the movable sleeve 46, and additionally permits vertical adjustment of the position of the movable arm 114 along the movable sleeve 46. However, other temporary or permanent retaining means such as pins, screws, bolts, clamps, welding or the like could also be used.

Key elements of the invention are a first elongated rotation stop 110 and second elongated rotation stop 112, both oriented parallel to the first axis 24, and integrally connected to the first end 82 and the second end 84 of the fixed arm 80 respectively. These upwardly extending rotation stops 110 and 112 prevent the movable arm 114 from rotating due to the torquing force applied by the expander means. Depending upon the thread convention of the threaded rod 66, right or left, one of the rotation stops prohibits movable arm 114 rotation when the bow press is being expanded, and the other rotation stop prohibits movable arm 114 rotation when the bow press is being contracted.

Another aspect of the invention resides in the fact that the first longitudinal portion 117 and the second longitudinal portion 119 of the movable arm 114 are angled downward toward the planar base 32. This unique design feature vertically lowers the location of the third and fourth bow engaging means 122 and 124 respectively with respect to the first and second bow engaging means 92 and 94 respectively. This permits the bow press to accommodate totally relaxed or unstrung bows in their near straight state. The shown embodiment depicts a useful downward angle. Other lesser or greater downward angles can also be utilized and are considered to be within the scope of the present invention.

Figure 6:
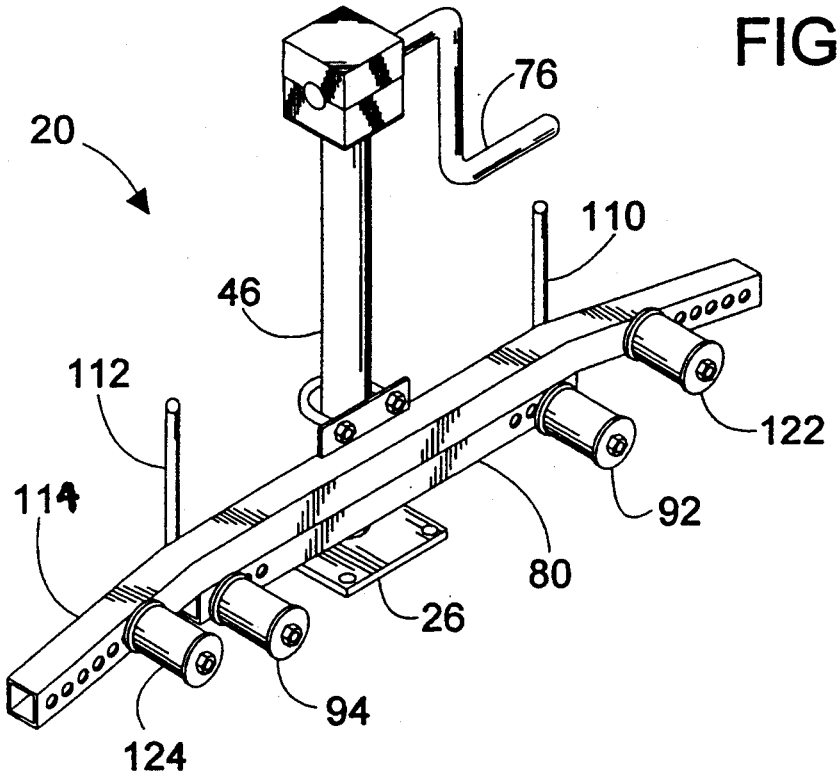
FIG. 6 is a perspective view of the bow press shown in the contracted or closed position.

FIG. 6 is a perspective view of the bow press shown in the contracted or closed position. The movable arm 114 is resting upon the fixed arm 80. The rotation stops 110 and 112 are positioned behind the movable arm 114 and prevent the movable arm 114 from rotating with respect to the fixed arm 80.

Figure 7:
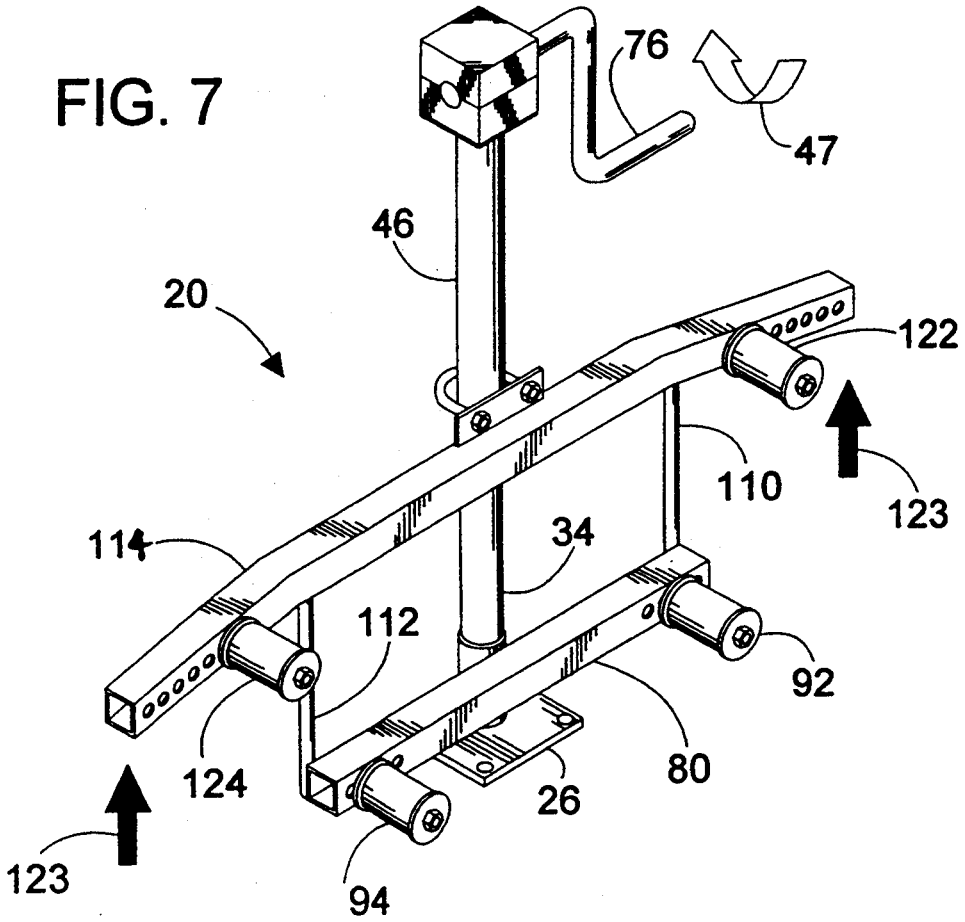
FIG. 7 is a perspective view of the bow press shown in the expanded or open position.

FIG. 7 is a perspective view of the bow press shown in the expanded or open position. Rotation handle 76 has been turned in the direction of the arrow 47. The expander means has resultantly caused the movable sleeve 46 and the connected movable arm 114 to move upward in the direction of the arrows 123 along support shaft 34. Rotation stops 110 and 112 serve to guide the upward travel of the movable arm 114 and prevent the movable arm 114 from rotating with respect to fixed arm 80.

Figure 8:
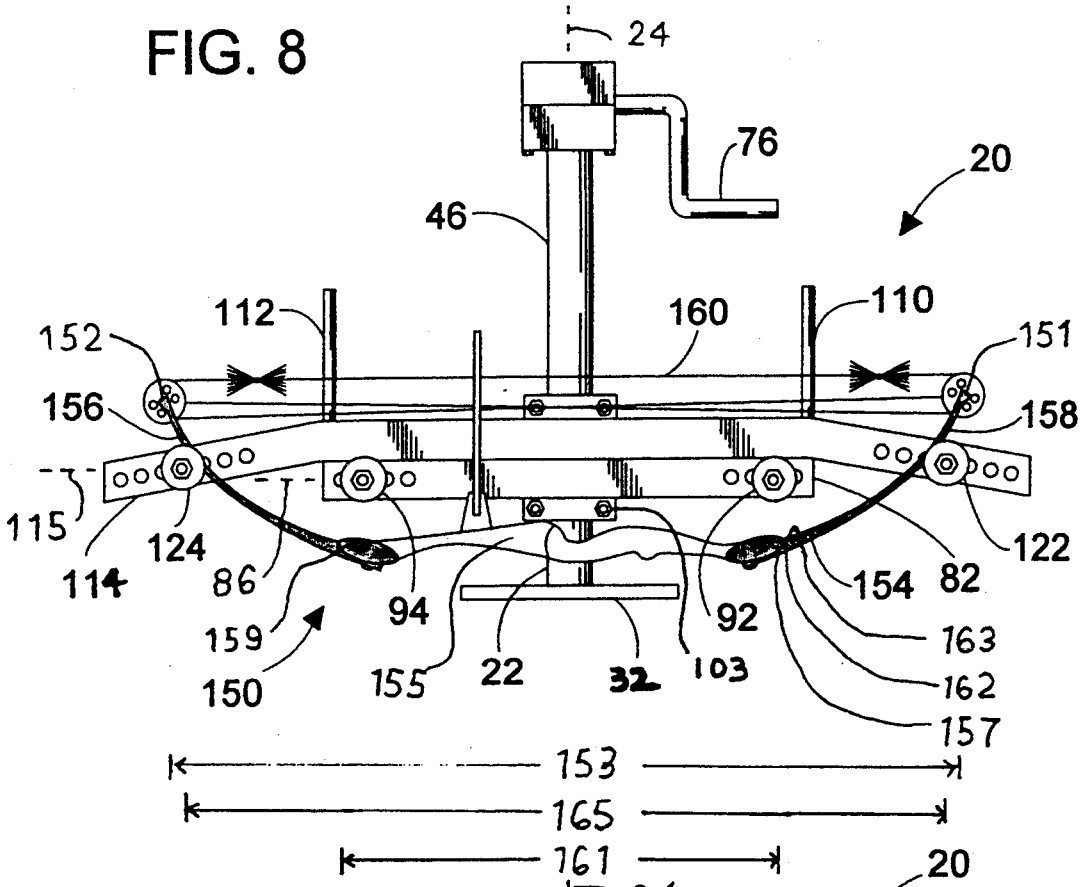
FIG. 8 is a front view of the bow press showing an installed bow in the tensioned position.

FIG. 8 is a front view of the bow press 20 showing an installed bow 150 in the tensioned position. The bow has front and rear sides 162 and 163, respectively, and first and second ends 151 and 152 spaced a first predetermined length 153 from each other. A substantially rigid central portion 155 has first and second ends 157 and 159 spaced a second predetermined length 161 from each other. The second predetermined length is at least one-third of the first predetermined length. First and second limbs 156 and 158 are coupled to the ends of the rigid central portion.

The bow press 20 is expandable along the first axis 24. The fixed first and second bow engaging means 92 and 94 are coupled to bow press along the second axis 86 perpendicular to the first axis. The movable third and fourth bow engaging means 122 and 124 are spaced a fixed distance 165 relative to each other and are coupled to the bow press along the third axis 115 parallel to the second axis. The first bow engaging means is positioned to abut the rear side of the bow adjacent the first end of the central portion. The second bow engaging means is positioned to abut the rear side of the bow adjacent the second end of the central portion. The third bow engaging means is positioned to abut the front side of the first limb. And the fourth bow engaging means is positioned to abut the front side of the second limb.

The bow 150 is placed in the bow press 20 by resting the limbs 156, 158 upon the third and fourth bow engaging means 122, 124 respectively. The face of the bow 154 hangs below the first and second bow engaging means 92 and 94 respectively. The string 160 is in the tensioned position.

Figure 9:
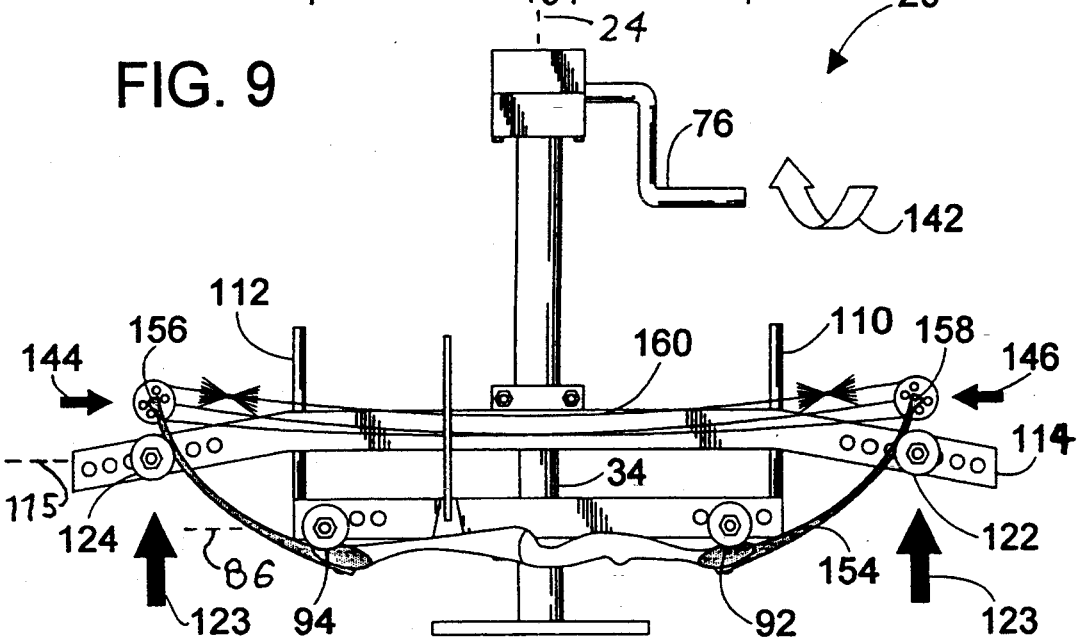
FIG. 9 is a front view of the bow press showing the bow in the compressed position.

FIG. 9 is a front view of the bow press showing the installed bow in the compressed position. Rotation handle 76 has been turned in the direction of the arrow 47. The expander means has resultantly caused the movable arm 114 to move upward in the direction of the arrows 123 along support shaft 34. During the expansion of the bow press 20, the third and fourth bow engaging means 122 and 124 have moved only parallel to the first axis 24 in the direction of the arrows 123. The upward movement of the movable arm 114 in the direction of the arrows 123 causes the rear 162 of the bow 150 to engage the fixed first and second bow engaging means 92 and 94 respectively. Continued upward motion of the movable arm 114 causes the first and second bow engaging means 92 and 94 respectively to exert force on the limbs of the bow 156 and 158 causing the limbs of the bow 156 and 158 to compress inwardly in the direction of arrows 144 and 146 and therefore relax the tension in the bow string 160.

Figure 10:
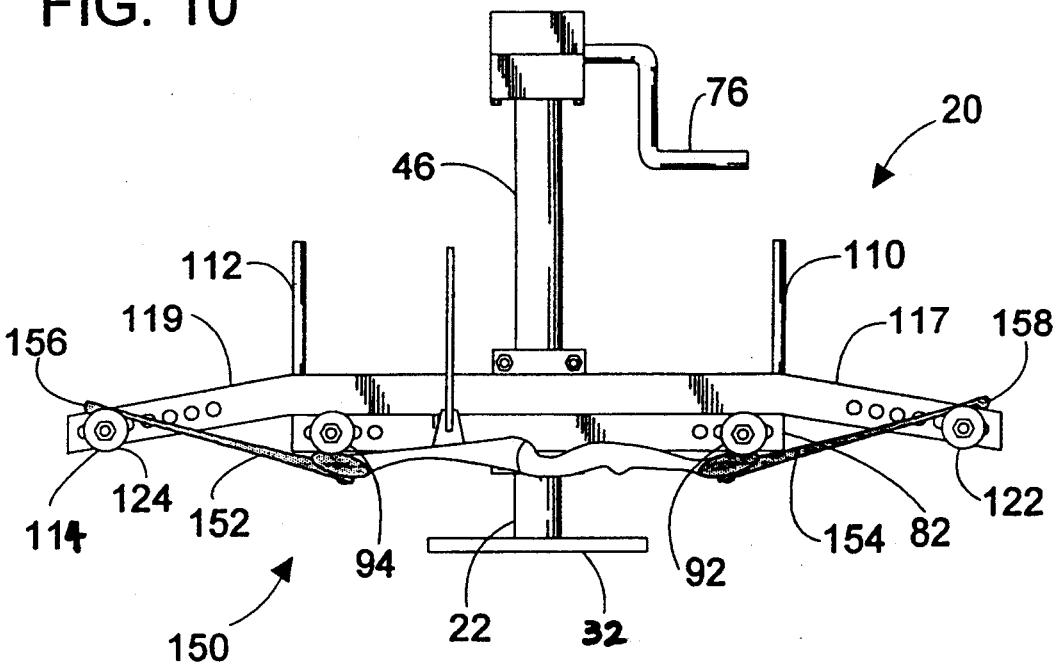
FIG. 10 is a front view of the bow press showing an installed totally relaxed compound bow; and, FIG. 11 is a front view of the bow press showing an installed totally relaxed straight bow.

FIG. 10 is a front view of a bow press showing an installed unstrung and totally relaxed compound bow. The important feature here is that the first longitudinal portion 117 and the second longitudinal portion 119 of the movable arm 114 are angled downwardly toward the planar base 32. Because of the downward angle of the outer portions of the movable arm 114, the third bow engaging means 122 and fourth bow engaging means 124 are brought in near vertical alignment with the first bow engaging means 92 and the second bow engaging means 94. This relative vertical positioning of the bow engaging means is important in that it permits a totally relaxed compound bow to be installed in the bow press, and subsequently compressed to permit stringing of the bow so as to place the bow in shooting order.

Figure 11:
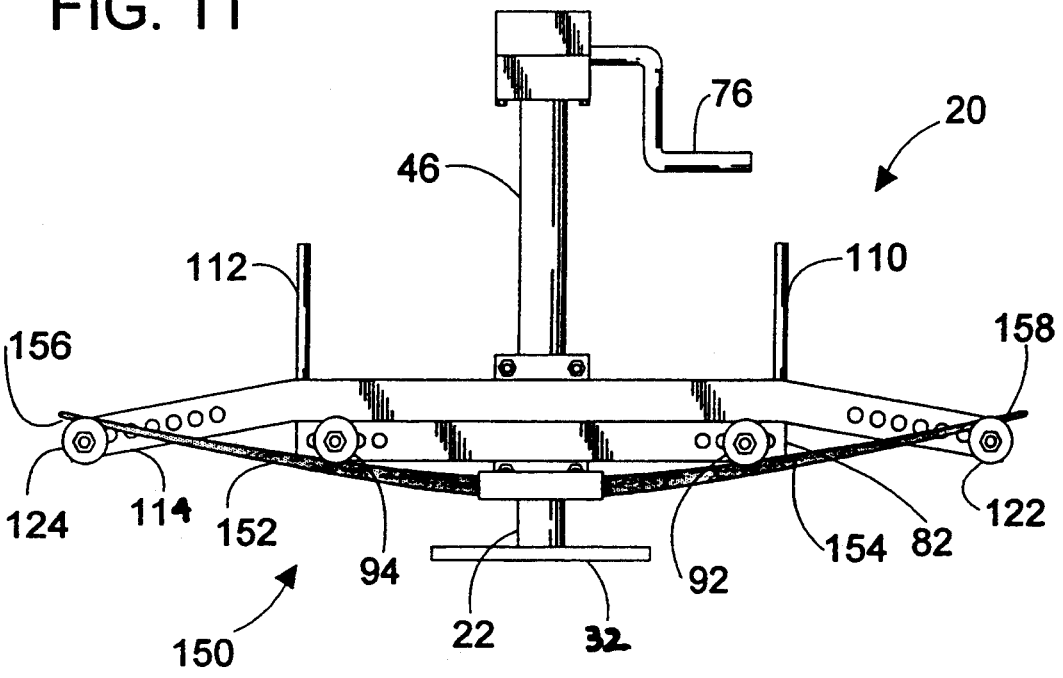

FIG. 11 is a front view of the bow press showing an installed unstrung and totally relaxed straight bow. As was the case for the compound bow of FIG. 10, the downward angle of the outer portions of the moveable arm 114 permit the installation and subsequent compression of a relaxed straight bow.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A bow press for compressing a bow having first and second ends spaced a first predetermined length from each other, a substantially rigid central portion having first and second ends spaced a second predetermined length from each other, the second predetermined length being at least one-third of the first predetermined length, first and second limbs, and front and rear sides, comprising:

an expander means expandable along a first axis;

fixed first and second bow engaging means coupled to said expander means along a second axis perpendicular to said first axis, said first bow engaging means positioned to abut the rear side of the bow adjacent the first end of the central portion, said second bow engaging means positioned to abut the rear side of the bow adjacent the second end of the central portion;

movable third and fourth bow engaging means coupled to said expander means along a third axis parallel to said second axis and spaced a fixed distance relative to each other, said third bow engaging means positioned to abut the front side of the first limb, said fourth bow engaging means positioned to abut the front side of the second limb; and, said third and fourth bow engaging means moving only parallel to said first axis when said expander means is expanded.

2. A bow press according to claim 1, wherein said expander means is a jackscrew.

3. A bow press according to claim 2, further comprising a rotation stop for stopping rotation of said third and fourth bow engaging means with respect to said first and second bow engaging means.

4. A bow press according to claim 3, wherein said rotation stop includes a first rotation stop adjacent said first bow engaging means and a second rotation stop adjacent said second bow engaging means.

5. A bow press according to claim 1, wherein said first, second, third and fourth bow engaging means are substantially in a straight line when said bow press is in a contracted position.

6. A bow press for compressing a bow having front and rear sides, a central portion, and first and second limbs, comprising:

an expander means expandable along a first axis;

a fixed arm coupled to said expander means along a second axis perpendicular to said first axis;

a movable arm having a central longitudinal portion coupled to said expander means parallel to said fixed arm; and, bow engaging means coupled to said fixed and movable arms for exerting force upon the bow when said expander means is expanded along said first axis, said bow engaging means further including first and second bow engaging means coupled to said fixed arm for contacting the rear side of the central portion of the bow, and third and fourth bow engaging means coupled to said movable arm for contacting the front side of the first and second limbs of the bow.

7. A bow press according to claim 6, wherein said expander means is a jackscrew.

8. A bow press according to claim 6, further comprising a first rotation stop for stopping rotation of said movable arm with respect to said fixed arm.

9. A bow press according to claim 8, wherein:

said fixed arm has first and second ends spaced from each other; and, said first rotation stop is coupled to said fixed arm adjacent said first end.

10. A bow press according to claim 9, further comprising a second rotation stop coupled to said fixed arm adjacent said second end.

11. A bow press according to claim 6, wherein said first, second, third and fourth bow engaging means are substantially in a straight line when said bow press is in a contracted position.

12. A bow press for compressing a bow, comprising:

a fixed sleeve longitudinally oriented around a first axis, said sleeve having a first end and a second end opposite to said first end, said sleeve having a predetermined internal cross sectional area;

a substantially planar base, said base defining a plane perpendicular to said first axis, said base being perpendicularly connected to said first end of said fixed sleeve;

a support shaft longitudinally oriented around said first axis, said shaft having a first end and a second end opposite to said first end, said support shaft having a predetermined external cross sectional area sized to longitudinally fit into said predetermined internal cross sectional area of said fixed sleeve, said first end of said support shaft longitudinally inserted into said second end of said fixed sleeve;

a first retaining means for holding said support shaft in position within said fixed sleeve, said first retaining means engaging said support shaft and said fixed sleeve and firmly holding said support shaft in position inside said fixed sleeve;

a movable sleeve longitudinally oriented around said first axis, said movable sleeve having a first end and a second end opposite to said first end, said movable sleeve having an internal cross sectional area equal to said predetermined internal cross sectional area of said fixed sleeve, said second end of said support shaft longitudinally inserted into said first end of said movable sleeve;

a mounting flange integrally connected to said second end of said movable sleeve, said mounting flange having an aperture of predetermined diameter axially oriented around said first axis;

an expander means for expanding and contracting the bow press movably connected to said second end of said support shaft, said expander means further connected to said mounting flange;

a fixed arm of predetermined length, said fixed arm oriented along a second axis perpendicular to said first axis, said fixed arm having a first end and a second end opposite to said first end, said fixed arm further having a first longitudinal portion adjacent to said first end, a second longitudinal portion adjacent to said second end, and a central longitudinal portion located between said first longitudinal portion and said second longitudinal portion, said central longitudinal portion of said fixed arm connected to said fixed sleeve, said first longitudinal portion and said second longitudinal portion having a plurality of holes axially oriented along a fourth axis perpendicular to said first axis and said second axis;

a first bow engaging means for exerting force from said fixed arm to the bow, said first bow engaging means connected to one of said plurality of holes in said first longitudinal portion of said fixed arm;

a second bow engaging means for exerting force from said fixed arm to the bow, said second bow engaging means connected to one of said plurality of holes in said second longitudinal portion of said fixed arm;

a second retaining means for connecting said fixed arm to said fixed sleeve, said second retaining means connected to said central longitudinal portion of said fixed arm and to said fixed sleeve, said second retaining means firmly holding said fixed arm in position along said fixed sleeve;

a movable arm of a length longer than the predetermined length of said fixed arm, said movable arm oriented parallel to said second axis, said movable arm having a first end and a second end opposite to said first end, said movable arm further having a first longitudinal portion adjacent to said first end, a second longitudinal portion adjacent to said second end, and a central longitudinal portion located between said first longitudinal portion and said second longitudinal portion, said central longitudinal portion of said movable arm connected to said movable sleeve, said first longitudinal portion and said second longitudinal portion having a plurality of holes axially oriented parallel to said fourth axis;

a third bow engaging means for exerting force from said moving arm to the bow, said third bow engaging means connected to one of said plurality of holes in said first longitudinal portion of said movable sleeve;

a fourth bow engaging means for exerting force from said movable arm to the bow, said bow engaging means connected to one of said plurality of holes in said second longitudinal portion of said movable sleeve; and, a third retaining means for connecting said movable arm to said movable sleeve, said third retaining means connected to said central longitudinal portion of said movable arm and to said movable sleeve, said third retaining means firmly holding said movable arm in position along said movable sleeve.

13. A bow press according to claim 12, said expander means further comprising:

a threaded aperture axially oriented around said first axis, said threaded aperture integrally connected to said second end of said support shaft;

a threaded rod longitudinally oriented along said first axis, said threaded rod having a first end and a second end opposite to said first end, said threaded rod having threads sized to fit said threaded aperture, said threaded rod having a diameter slightly less than said predetermined diameter of said aperture of said mounting flange, said first end of said threaded rod longitudinally inserted into said aperture so that said first end engages said threaded aperture of said support shaft;

a first bevel gear integrally connected to said second end of said threaded rod, said first bevel gear centrally oriented along said first axis;

a rotation handle;

a second bevel gear axially connected to said rotation handle, said second bevel gear perpendicularly meshing with said first bevel gear; and, a housing connected to said mounting flange, said housing having two support holes, said holes receiving and firmly holding said rotation handle so that said first bevel gear and said second bevel gear are continuously meshed.

14. A bow press according to claim 12, said fixed arm further comprising a first elongated rotation stop oriented parallel to said first axis, said first rotation stop integrally connected to said first end of said fixed arm, and a second elongated rotation stop oriented parallel to said first axis, said second rotation stop integrally connected to said second end of said fixed arm.

15. A bow press according to claim 12, wherein each of said bow engaging means includes a spool roller having an axis of rotation parallel to said fourth axis.

16. A bow press according to claim 12, wherein said second retaining means includes a first arm flange integrally connected to said fixed arm, said first arm flange having two holes, said second retaining means further comprising a first U bolt surrounding said fixed sleeve, said first U bolt removably connected to said first arm flange.

17. A bow press according to claim 12, wherein said third retaining means includes a second arm flange integrally connected to said movable arm, said second arm flange having two holes, said third retaining means further comprising a second U bolt surrounding said movable sleeve, said second U bolt removably connected to said second arm flange.

18. A bow press according to claim 12, wherein said first longitudinal portion and said second longitudinal portion of said movable arm are angled toward said planar base.

19. A method for compressing a bow having front and rear sides, a central portion, and first and second limbs, comprising the steps of:

providing a bow press having an expander means expandable along a first axis, a fixed arm coupled to said expander means along a second axis perpendicular to said first axis and having first and second bow engaging means, a movable arm having a central longitudinal portion coupled to said expander means parallel to said fixed arm and third and fourth bow engaging means;

placing the front of the first and second limbs of the bow upon said third and fourth bow engaging means; and, actuating said expander means causing said movable arm to move along said first axis moving the rear of the central portion of the bow into engagement with said first and second bow engaging means to thereby cause inward compression of the first and second limbs of the bow toward each other.

* * * * *